US005430902A

United States Patent [19]

Lewis

[11] Patent Number: 5,430,902

[45] Date of Patent: Jul. 11, 1995

[54] PILLOWCASE CONSTRUCTION

[76] Inventor: Doris Lewis, 73 Gamewell La., Willingboro, N.J. 08046

[21] Appl. No.: 310,517

[22] Filed: Sep. 22, 1994

[51] Int. Cl.[6] ..... A47G 9/02

[52] U.S. Cl. ..... 5/490; 5/485

[58] Field of Search ..... 5/485, 490, 499, 630

[56] References Cited

U.S. PATENT DOCUMENTS

| | | | |
|---|---|---|---|
| 1,343,881 | 6/1920 | Christensen . | |
| 1,372,270 | 3/1921 | Borland | 5/490 X |
| 1,775,061 | 9/1930 | Bertha | 5/490 |
| 1,775,061 | 9/1930 | Bertha . | |
| 1,854,023 | 4/1932 | Ehni . | |
| 2,179,175 | 11/1939 | Cohen, Jr. | 5/499 |
| 2,217,999 | 10/1940 | De Woskin . | |
| 2,759,200 | 8/1956 | Johnston | 5/490 |
| 3,267,496 | 8/1966 | Gionet | 5/490 |
| 3,974,531 | 8/1976 | Van Pelt | 5/490 |
| 4,074,373 | 2/1978 | Garofalo . | |
| 4,309,784 | 1/1982 | Cohne . | |
| 4,651,371 | 3/1987 | Hahn . | |
| 4,688,286 | 8/1987 | Miker, Jr. . | |
| 4,780,921 | 11/1988 | Lahn et al. | 5/490 X |
| 4,815,154 | 3/1989 | Grimes . | |
| 4,864,669 | 9/1989 | Jones . | |
| 4,924,543 | 5/1990 | Hoss et al. . | |
| 5,084,928 | 2/1992 | Skillington . | |
| 5,099,533 | 3/1992 | Bland . | |
| 5,127,117 | 7/1992 | Bridges . | |
| 5,193,238 | 3/1993 | Clute . | |

*Primary Examiner*—Michael F. Trettel
*Attorney, Agent, or Firm*—Sperry, Zoda & Kane

[57] ABSTRACT

A configuration for a pillowcase for use in covering of a conventional bed sleeping pillow wherein the pillowcase includes an upper planar member having two lateral edges and two longitudinal edges and a lower planar member also have two lateral and two longitudinal edges. The two planar members are integrally formed along the bottom edge therebetween and are attached along the side edges. The two remaining longitudinal edges define an access opening for allowing placement and removal of a pillow extending therethrough. This design further includes a closing flap integrally formed with respect to the longitudinal edge of the upper planar member and includes a hook and loop fastening means thereon detachably securable with a mated hook and loop fastening device positioned on the lower planar member such that the flap extends across the pillow access opening for retaining of the pillow firmly therein. The final design provides an overall smooth appearance which allows firm retaining of a pillow therein and ease of removal and replacement thereof while having no stitching on the surface of either the upper portion of the pillow or the lower portion of the pillow.

1 Claim, 2 Drawing Sheets

PILLOWCASE CONSTRUCTION

BACKGROUND OF THE INVENTION

1. Field of the Invention

The present invention deals with the field of devices generally described as bedding. In particular the present invention provides a specific construction for forming of a pillow encasing member preferably formed of cotton for extending about a pillow for protecting of the pillow, keeping the pillow itself sanitary and facilitating removal and replacement of the pillowcase for cleaning thereof.

2. Description of the Prior Art

Many devices have been patented on bedding and other pillow encasing members for providing pillowcase constructions. These numerous designs show various types of means including devices for attaching of pillows with respect to beds and different types of manners of securing and enclosing a pillowcase over a pillow. None of the designs shows the configuration of the present invention.

Examples of such patents showing these designs are disclosed in U.S. Pat. No. 1,343,881 patented Jun. 15, 1920 to I. Christensen on a "Bedspread"; and U.S. Pat. No. 1,372,270 patented Mar. 22, 1921 to J. Borland on a "Cushion"; and U.S. Pat. No. 1,775,061 patented Sep. 2, 1930 to G. Bertha on a "Duplex Pillow Slip"; and U.S. Pat. No. 1,854,023 patented Apr. 12, 1932 to E. M. Ehni on a "Pillowcase Construction"; and U.S. Pat. No. 2,217,999 patented Oct. 15, 1940 to I. S. De Woskin and assigned to Erex Non-Allergic Products Company on a "Pillowcase Closure"; and U.S. Pat. No. 4,074,373 patented Feb. 21, 1978 to F. Garofalo and assigned to F. Garofalo Electric Co., Inc. on a "System For Attaching Pillow To X-Ray Table"; and U.S. Pat. No. 4,309,784 patented Jan. 12, 1982 to P. Cohen on a "Pillow-Display Case"; and U.S. Pat. No. 4,651,371 patented Mar. 24, 1987 to B. Hahn on "Bed Linens With Releasable Fasteners"; and U.S. Pat. No. 4,688,286 patented Aug. 25, 1987 to L. Miker, Jr. on a "Pillow Having Storage Compartments"; and U.S. Pat. No. 4,815,154 patented Mar. 28, 1989 to J. Grimes on a "Beach Pillow"; and U.S. Pat. No. 4,864,669 patented Sep. 12, 1989 to C. Jones on an "Atraumatic Pillow And Pillowcase"; and U.S. Pat. No. 4,924,543 patented May 15, 1990 to M. Hoss et al on a "Sheet With Attached Cover And Removable Pillowcases And Impermeable Sheet"; and U.S. Pat. No. 5,084,928 patented Feb. 4, 1992 to A. Skillington on a "Pillowcase Formed Of Elastic Fabric"; and U.S. Pat. No. 5,099,533 patented Mar. 31, 1992 to M. Bland on a "Partial Pillow Cover"; and U.S. Pat. No. 5,127,117 patented Jul. 7, 1992 to R. Bridges on a "Pillow Construction"; and U.S. Pat. No. 5,193,238 patented Mar. 16, 1993 to L. Clute on an "Infant Support Pillow".

SUMMARY OF THE INVENTION

The present invention deals with the field of pillowcase constructions particularly usable for covering of a conventional bed sleeping pillow. The construction of the pillowcase includes an upper planar member which is generally rectangular in shape and includes two upper lateral edges each being approximately 21" in length. The two lateral edges are on opposite sides of the rectangular upper planar member. The upper planar member also defines two longitudinal edges thereon each approximately 28" in length parallel with respect to one another. Each of the upper longitudinal edges extends from the first upper lateral edge to the second upper lateral edge to form the rectangular configuration of the upper planar member.

The first upper longitudinal edge and the second upper longitudinal edge are both longer than either of the upper lateral edges and preferably in the ratio of approximately 28 to 21.

The design of the present invention further includes a lower planar member which is also preferably rectangular in shape approximately equal to the shape of the upper planar member. This lower planar member is positioned adjacent the upper planar member and defines a pillow receiving chamber between. The lower planar member includes a first hook and loop engagement device, such as commonly sold under the trademark Velcro, positioned thereon.

The configuration of the lower planar member includes a first lower lateral edge approximately 21" in length positioned adjacent the first upper lateral edge of the upper planar member and preferably sewn or stitched thereto. A second lower lateral edge is included which is approximately 21" in length and is positioned oppositely on the lower planar member from the first lower lateral edge and positioned distant therefrom. The second lower lateral edge is preferably located adjacent the second upper lateral edge and is sewn or stitched thereto.

A first lower longitudinal edge of approximately 28" in length extends along the lower planar member between the first lower lateral edge and the second lower lateral edge. The upper planar member is preferably integrally formed with respect to the lower planar member along this first upper longitudinal edge and this first lower longitudinal edge respectively.

A second lower longitudinal edge of approximately 28" in length extends along the lower planar member between the first lower lateral edge and the second lower lateral edge at a position spatially disposed from the first lower longitudinal edge. This first lower longitudinal edge and the second lower longitudinal edge are longer than either of the first lower lateral edge or the second lower lateral edge. The second lower longitudinal edge is preferably positioned adjacent to the second upper longitudinal edge to define therebetween a pillow access opening in communication with the pillow receiving chamber to allow removal and replacement of the sleeping pillow through this pillow access opening into and out of the pillow receiving chamber. Preferably the second longitudinal edge also includes an opening hem extending therealong to facilitate wear thereof and to facilitate defining of the pillow access opening thereadjacent.

The configuration of the present invention further includes a closing flap which is integrally formed with the second upper longitudinal edge and extends outwardly therefrom to extend over the pillow access opening for closing thereof. This closing flap is generally triangular in shape and includes a second hook and loop engagement means commonly sold under the trademark Velcro, secured thereto for facilitating securement with respect to the first hook and loop engagement means positioned on the lower planar member in such a manner as to allow detachable securement of the closing flap in position extending over the pillow access opening for closing thereof and retaining of a sleeping pillow within the pillow receiving chamber.

This closing flap preferably will include a closing flap hem extending along at least a portion thereof for facilitating wear thereof and aiding in positioning of the flap extending over the pillow access opening for retaining of a sleeping pillow within the pillow receiving chamber.

It is an object of the present invention to provide a pillowcase construction for use in covering of a conventional bed sleeping pillow wherein initial costs are minimized.

It is an object of the present invention to provide a pillowcase construction for use in covering of a conventional bed sleeping pillow wherein maintenance costs are minimal.

It is an object of the present invention to provide a pillowcase construction for use in covering of a conventional bed sleeping pillow wherein ease of placement of a pillow within the pillowcase is facilitated.

It is an object of the present invention to provide a pillowcase construction for use in covering of a conventional bed sleeping pillow wherein ease of removal of a pillow from the pillowcase is further facilitated.

It is an object of the present invention to provide a pillowcase construction for use in covering of a conventional bed sleeping pillow wherein an access opening is provided along a longitudinal or longer edge of the pillowcase to facilitate replacement and removal of the pillow from therein.

It is an object of the present invention to provide a pillowcase construction for use in covering of a conventional bed sleeping pillow wherein two planar members form a pillowcase shell which encases a pillow and does not provide any stitched or sewn edges against the facial area of a user.

It is an object of the present invention to provide a pillowcase construction for use in covering of a conventional bed sleeping pillow wherein accidental removal of the pillowcase from the sleeping pillow is extremely difficult.

It is an object of the present invention to provide a pillowcase construction for use in covering of a conventional bed sleeping pillow wherein infection and disease control is facilitated by covering of the entire pillow in an efficient manner.

It is an object of the present invention to provide a pillowcase construction for use in covering of a conventional bed sleeping pillow wherein no open lateral edges are provided in the pillow.

It is an object of the present invention to provide a pillowcase construction for use in covering of a conventional bed sleeping pillow wherein expenses are minimized by eliminating the need for any type of closing mechanism such as a zipper or closing drawstring.

It is an object of the present invention to provide a pillowcase construction for use in covering of a conventional bed sleeping pillow wherein time is saved by allowing easy removal and replacement of a pillowcase over a pillow by having access through the larger opening in the pillowcase rather than the smaller opening.

It is an object of the present invention to provide a pillowcase construction for use in covering of a conventional bed sleeping pillow wherein touching of the pillow itself during removal of the pillowcase and placement of a new pillowcase thereon is minimized.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
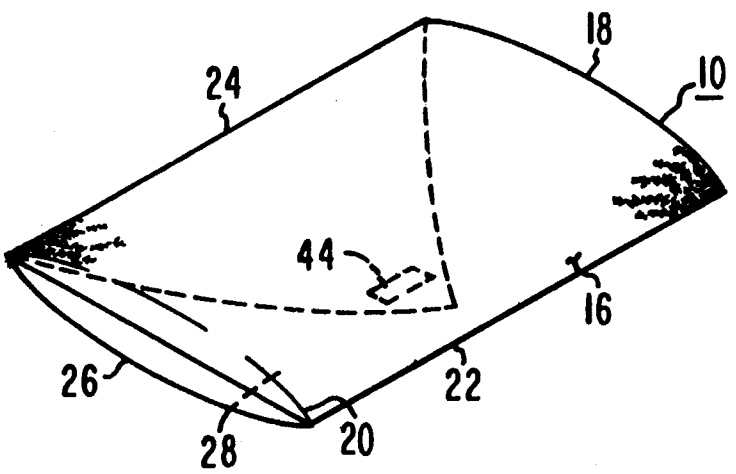
FIG. 1 is a top perspective illustration of an embodiment of a pillowcase construction of the present invention for use in covering of a conventional bed sleeping pillow.
Figure 2:
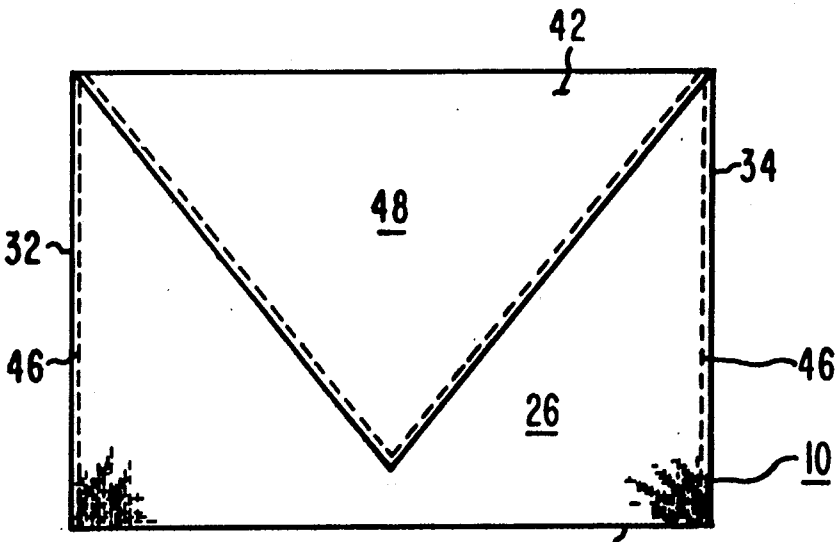
FIG. 2 is a bottom plan view showing the flap closed of the configuration shown in FIG. 1.

The present invention provides a pillowcase 10 for use in retaining of a sleeping pillow 12 therein for maintaining the sleeping pillow in a germ free environment. Such a pillowcase 10 allows re-use of the pillow 12 over and over again while the individual pillowcases 10 themselves can be repeatedly washed for maintaining cleanliness of the pillowcase and pillow combination. Such a sleeping pillow 12 with a pillowcase 10 are normally positioned upon a bed 14 in such a manner as to allow the head of the user to be placed thereon to facilitate sleeping.

The construction of the pillowcase 10 of the present invention includes an upper planar member 16 which includes a first upper lateral edge means of approximately 21" in length and a second upper lateral edge means 20 of approximately 21" in length. These lateral edges are parallel to each other and spatially disposed from each other on the upper planar member 16 at opposite edges preferably.

The upper planar member 16 also includes two longitudinal edges mainly the first upper longitudinal edge 22 and the second upper longitudinal edge 24. Each of these edges are approximately 28" in length and extend between the first upper lateral edge 18 and the second upper lateral edge 20 at opposite ends thereof. As such, the configuration of the upper planar member 16 being rectangular is formed by the two lateral edges 18 and 20 and the two longitudinal edges 22 and 24.

The configuration of the present invention further includes a lower planar member 26 which is of a similar shape and configuration to the upper planar member 16. Lower planar member 26 includes a first lower lateral edge 32 and a second lower lateral edge 34. Both of these lateral edges are preferably 21" in length and are positioned at opposite sides on the lower planar member 26. Also the lower planar member 26 includes a first lower longitudinal edge 36 and a second lower longitudinal edge 38 extending generally parallel to one another and spaced from one another. The longitudinal edges 36 and 38 extend between the opposite ends of the lateral edges 32 and 34 to form the rectangular shape of the lower planar member 26. When in position the upper planar member 16 and the lower planar member 26 will overlie one another and be connected about a portion of the peripheral area thereof. In this overlying position the upper planar member 16 and the lower planar member 26 will define therebetween a pillow receiving chamber 28. With a pillow positioned in the pillow receiving chamber 28 it will be encased thereby.

In the overlying position between planar members 16 and 26 the second upper lateral edge 20 will extend along and adjacent the second lower lateral edge 34. Edges 20 and 34 will be connected to one another such as by sewing or stitching along the complete length thereof to prevent access to a pillow located within the pillow receiving chamber 28 along either the second upper lateral edge 20 or the second lower lateral edge 34.

Also the first upper lateral edge 18 will be positioned adjacent the first lower lateral edge means 32 and will be connected to one another by stitching or sewing such that access to a pillow 12 positioned within the pillow receiving chamber 28 will be prevented along the first upper lateral edge 18 or the first lower lateral edge 32.

With the planar members 16 and 26 in the overlying position the first upper longitudinal edge 22 will be positioned adjacent the first lower longitudinal edge 36. These edges can be connected with respect to one another but within the current embodiment they are actually formed integral with respect to one another. With this integral form the upper planar member 16 will be integral with respect to the lower planar member 26 entirely along the length of the first upper longitudinal edge 22 and the first lower longitudinal edge 36.

Further in the overlying position the upper planar member 16 will include a second upper longitudinal edge means 24 and the lower planar member 26 will include a second lower longitudinal edge means 38. These edges will not be interconnected with respect to one another and, as such, will define therebetween a pillow access opening 40 to allow movement of the pillow through this access opening 40 into the pillow receiving chamber 28 defined between the upper planar member 16 and the lower planar member 26.

A closing flap means 42 is preferably formed integrally with the second upper longitudinal edge means 24 and extending outwardly therefrom in a triangular shape 48 such as to extend over the pillow access opening 40 for closing thereof and preventing exiting of a pillow retained within the pillow receiving chamber 28. With the triangular shaped closing flap 42 extending thereover it is preferable to include a means for securing of the closing flap 42 to the lower planar member 26. This is achieved by a first hook and loop interlocking means 30 such as commonly sold under the trademark Velcro positioned on the lower plan member 26 which is complementary with respect to a second hook and loop engagement means 44 which may be positioned on the closing flap 42 itself. In the preferred configuration the closing flap 42 will include the loop engagement 50 and the lower planar member 26 will include the hook engagement member 52. With members 50 and 52 detachably securable with respect to one another the closing flap 42 can be positioned extending over the access opening to prevent removal of a pillow 12 from the pillow receiving chamber 28 or it can be detached to allow removal and replacement of the pillow within a new pillowcase.

In the configuration of the present invention as shown in this embodiment the closing flap 42 will be integral with respect to the upper planar member 16 along the second upper longitudinal edge 24 thereof. The upper planar member 16 in turn, will be integral with respect to the lower planar member 26 along the entire lateral length thereof up to the second lower longitudinal edge 38 which helps to define the pillow access opening 40. This single integral member will have the side areas thereof secured such as by lateral stitching or sewing 46 for preventing access through the side areas. In this manner access to the pillow receiving chamber 28 will only be provided through the longer longitudinal edge defining the pillow access opening 40.

Figure 3:
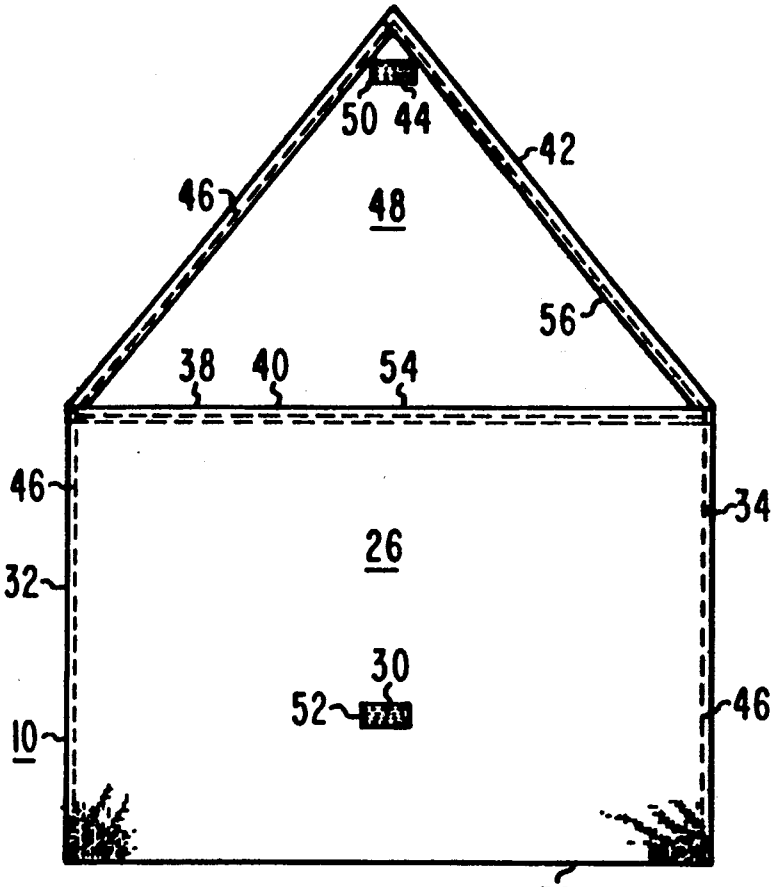
FIG. 3 is a bottom plan view of the configuration shown in FIG. 2 with the flap in the opened position.
Figure 4:
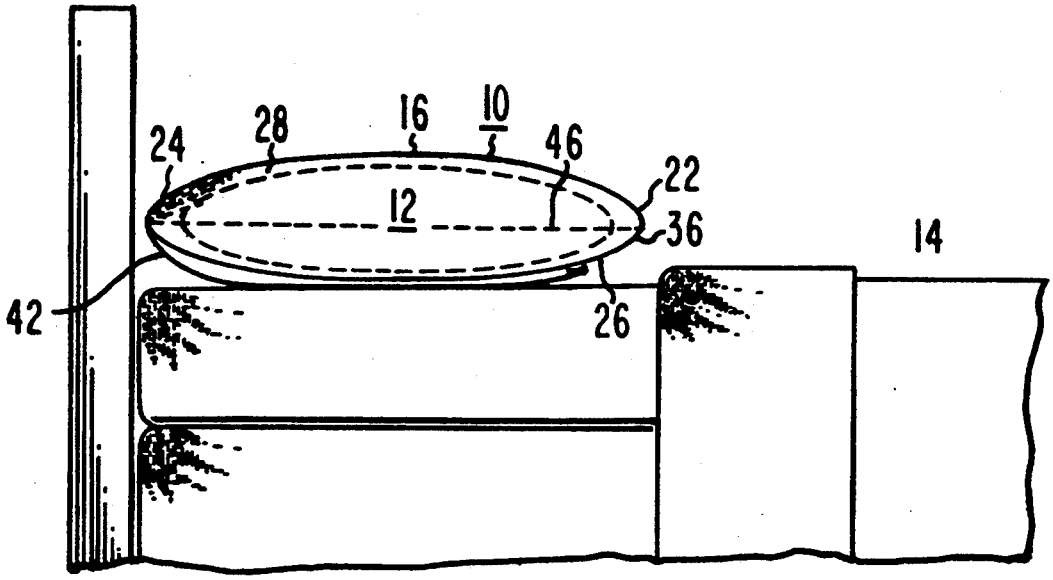
FIG. 4 is a side cross-sectional view of an illustration of the pillowcase construction of the present invention shown in position upon a sleeping bed.
Figure 5:
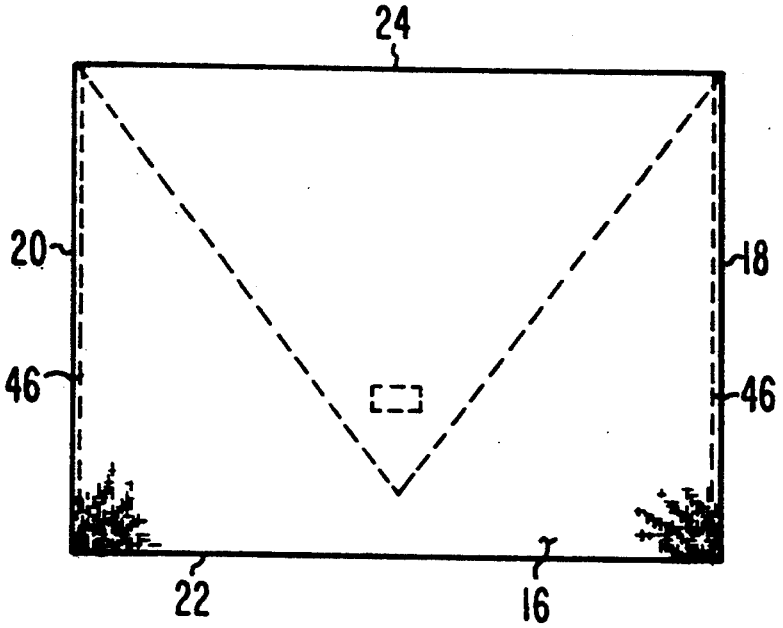
FIG. 5 is a top plan view of an embodiment of the pillowcase construction of the present invention shown for use in covering of a conventional bed sleeping pillow.

To further facilitate efficiency and aid in reducing wear on the pillowcase 10 made in accordance with the construction of the present invention an opening hem means 54 may be included along the second lower longitudinal edge 38. Additionally a closing flap hem means 56 may be positioned along at least a portion of the triangular shape of the closing flap means 42 as best shown in FIG. 3. In this manner the entire pillow access opening 40 can be surrounded by a hemmed edge to facilitate wear and to help in maintaining sanitary conditions.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A pillowcase construction for use in covering of a conventional bed sleeping pillow comprising:

A. a upper planar member being generally rectangular in shape and including:

(1) a first upper lateral edge means approximately twenty-one inches in length;

(2) a second upper lateral edge means approximately twenty-one inches in length positioned oppositely on said upper planar member from said first upper lateral edge means and spatially disposed therefrom;

(3) a first upper longitudinal edge means approximately twenty-eight inches in length extending along said upper planar member between said first upper lateral edge means and said second upper lateral edge means thereof;

(4) a second upper longitudinal edge means approximately twenty-eight inches in length extending along said upper planar member between said first upper lateral edge means and said second upper lateral edge means at a position spatially disposed from said first upper longitudinal edge means, said first upper longitudinal edge means and said second upper longitudinal edge means each being longer than either of said first upper lateral edge means and said second upper lateral edge means;

B. a lower planar member being generally rectangular in shape and positioned adjacent said upper planar member to define a pillow receiving chamber means therebetween, said lower planar member including a first hook and loop engagement means positioned thereon, said lower planar member including:

(1) a first lower lateral edge means approximately twenty-one inches in length positioned adjacent said first upper lateral edge means and sewn thereto;

(2) a second lower lateral edge means approximately twenty-one inches in length positioned oppositely on said lower planar member from said first lower lateral edge means and spatially disposed therefrom, said second lower lateral edge means being located adjacent said second upper lateral edge means and sewn thereto;

(3) a first lower longitudinal edge means approximately twenty-eight inches in length extending along said lower planar member between said first lower lateral edge means and said second lower lateral edge means thereof, said upper planar member being integrally formed with said lower planar member along said first upper longitudinal edge means and said first lower longitudinal edge means, respectively;

(4) a second lower longitudinal edge means approximately twenty-eight inches in length extending along said lower planar member between said first lower lateral edge means and said second lower lateral edge means at a position spatially disposed from said first lower longitudinal edge means, said first lower longitudinal edge means and said second lower longitudinal edge means each being longer than either of said first lower lateral edge means and said second lower lateral edge means, said second lower longitudinal edge means being positioned adjacent said second upper longitudinal edge means to define a pillow access opening therebetween in communication with said pillow receiving chamber to allow removal and replacement of a sleeping pillow through said pillow access opening into said pillow receiving chamber, said second lower longitudinal edge means including an opening hem means extending therealong to facilitate wear thereof and facilitate defining of said pillow access opening thereadjacent; and C. a closing flap means integrally formed with said second upper longitudinal edge means and extending outwardly therefrom to extend over said pillow access opening for closing same, said closing flap means being triangular in shape, said closing flap means including a second hook and loop engagement means secured thereon to facilitate securement with respect to said first hook and loop engagement means positioned on said lower planar member to detachably secure said closing flap means in position extending over said pillow access opening for closing thereof and retaining of a sleeping pillow within said pillow receiving chamber means, said closing flap means further including a closing flap hem means extending along at least a portion thereof to facilitate wear thereof and positioning thereof extending over said pillow access opening for retaining of a sleeping pillow within said pillow receiving chamber means.

* * * * *